US011471933B2

(12) United States Patent
Polossek

(10) Patent No.: US 11,471,933 B2
(45) Date of Patent: Oct. 18, 2022

(54) TOOL FOR JOINING COMPONENTS

(71) Applicant: Eckold GmbH & Co. KG, St. Andreasberg (DE)

(72) Inventor: Bernd Polossek, Osterode am Harz (DE)

(73) Assignee: ECKOLD GMBH & CO. KG, St. Andreasberg (DE)

( * ) Notice: Subject to any disclaimer, the term of this patent is extended or adjusted under 35 U.S.C. 154(b) by 0 days.

(21) Appl. No.: 17/066,016

(22) Filed: Oct. 8, 2020

(65) Prior Publication Data

US 2021/0114084 A1 Apr. 22, 2021

(30) Foreign Application Priority Data

Oct. 18, 2019 (DE) ..... 10 2019 128 229.2

(51) Int. Cl.
*B21J 15/20* (2006.01)
*B21J 15/32* (2006.01)

(52) U.S. Cl.
CPC ..... *B21J 15/20* (2013.01); *B21J 15/32* (2013.01)

(58) Field of Classification Search
CPC . B21J 15/025; B21J 15/20; B21J 15/26; B21J 15/32; B23P 19/062–063
See application file for complete search history.

(56) References Cited

U.S. PATENT DOCUMENTS 5,181,315 A * 1/1993 Goodsmith ..... B21J 15/32 227/119
2004/0111878 A1* 6/2004 Naito ..... B21J 15/32 29/798
2004/0217144 A1 11/2004 Matthews et al.
2012/0260491 A1* 10/2012 Draht ..... B21D 39/03 29/525.06

(Continued)

FOREIGN PATENT DOCUMENTS

CN 201086118 Y 7/2008
CN 201997663 U 10/2011

(Continued)

OTHER PUBLICATIONS

European Search report in EP Application No. 20201573.1-1016 dated Mar. 16, 2021, 3 pages.

*Primary Examiner* — Matthew P Travers
(74) *Attorney, Agent, or Firm* — Andrew M. Calderon; Calderon Safran & Cole, P.C.

(57) ABSTRACT

A tool for joining components, in particular at least two metal sheets lying flat on top of each other, with a housing, in which a primary tappet composed of a punch and a hold-down device is mounted such that it can be driven in the axial direction, a die assigned to the punch and an element feed that can be moved in the axial direction relative to the housing, via which auxiliary joining parts, especially rivets, can be fed to the primary tappet. At least one position coupled at least indirectly to the primary tappet and at least one position decoupled from the primary tappet can be (Continued)

assumed by the element feed, and the element feed can be moved in the coupled position together with the primary tappet in the axial direction and remains stationary relative to the housing in the decoupled position upon a movement of the primary tappet.

19 Claims, 26 Drawing Sheets

(56) References Cited

U.S. PATENT DOCUMENTS

| | | | | |
|---|---|---|---|---|
| 2014/0041193 | A1* | 2/2014 | Schlafhauser | B21J 15/285 29/432 |
| 2016/0325341 | A1* | 11/2016 | Gostylla | B21J 15/025 |
| 2016/0339549 | A1* | 11/2016 | Obrecht | B23P 19/062 |
| 2017/0216957 | A1* | 8/2017 | Hartwig-Biglau | B23K 11/0066 |
| 2017/0259326 | A1* | 9/2017 | Skolaude | B21J 15/26 |
| 2018/0272419 | A1* | 9/2018 | Draht | B21J 15/28 |
| 2020/0215600 | A1 | 7/2020 | Skolaude | |

FOREIGN PATENT DOCUMENTS

| | | | |
|---|---|---|---|
| CN | 107030366 | A | 8/2017 |
| EP | 1099495 | | 5/2001 |
| EP | 1379343 | | 1/2004 |
| EP | 2644298 | | 10/2013 |
| EP | 3242760 | | 11/2017 |
| WO | 2019053177 | | 3/2019 |

* cited by examiner

TOOL FOR JOINING COMPONENTS

FIELD OF INVENTION

The invention relates to a tool for joining components, in particular at least two metal sheets lying flat on top of each other, with a housing, in which a primary tappet composed of a punch and a hold-down device is mounted such that it can be driven in the axial direction, a die assigned to the punch and an element feed that can be moved in the axial direction relative to the housing, via which auxiliary joining parts, especially rivets, can be fed to the primary tappet.

BACKGROUND

This type of tool is described, for example, in EP 2 644 298 B1. In this case, a setting tool for self-piercing riveting is described. The primary tappet is used to drive a joining rivet into the two components arranged one above the other. The element feed, which connects the rivet to the primary tappet, moves together with the tappet in the direction of the die assigned to it. The tool may be driven hydraulically or electrically. This tool enables short cycle times because the primary tappet and the hold-down device, together with the element feeder, only have to cover a short distance from the rivet position to the rivet pick-up position and vice-versa to pick up the rivet. However, the disadvantage of this is the poor component accessibility due to the spatial size of the element feed.

To ensure very good component accessibility, the joining device described in EP 1 099 495 B1 is designed so that the element feed (rivet feed) is fixed to the housing and the punch must retract completely after driving in the rivet in order to feed a new rivet to the punch. This slows the cycle time of the joining device.

Thus, the two known joining devices have either the disadvantage of poor component accessibility with the advantage of a short cycle time, or the advantage of good component accessibility combined with the disadvantage of a long cycle time.

EP 3 242 760 B1 presents a tool for joining components with a feed unit for transferring a connecting element to the set head, which can be moved from a starting position to a freely adjustable intermediate position. This enables the transfer of the connecting element to the set head at different positions between the starting position and the working position. The set head and the feed unit can be moved independently of one another in a direction towards the working position.

SUMMARY

On this basis, the invention aims to improve the joining device described at the beginning in such a way that the two advantages of the different joining devices can be combined and the two disadvantages compensated.

To solve the issue, a tool for joining components according to the preamble is characterized in that at least one position I coupled at least indirectly to the primary tappet and at least one position II decoupled from the primary tappet can be assumed by the element feed, and the element feed can be moved in the coupled position I together with the primary tappet in the axial direction and remains stationary relative to the housing in the decoupled position II upon a movement of the primary tappet.

In one instance, this configuration enables a short cycle time if component accessibility plays a secondary or even marginal role and the element feed is always ready to feed the auxiliary joining part to the primary tappet; in another instance, the element feed can be operated in a fixed state with the housing if the length of the cycle time is of secondary importance because good component accessibility must be created during the joining operation.

Preferably, the coupling of the element feed with the primary tappet is achieved via a first coupling element, which is preferably a fluid cylinder and in particular a pneumatic cylinder. The coupling element can also comprise an electric drive.

The primary tappet is preferably surrounded by the secondary tappet, to which the element feed is fixed.

The secondary tappet can preferably be moved together with the primary tappet in the axial direction or the secondary tappet can be fixed in the housing while the primary tappet can move in the axial direction.

It is especially advantageous if the secondary tappet can be fixed in the housing in at least two different positions.

For fixing purposes, at least one radial recess or bore can be provided in the tubular secondary tappet, wherein especially preferably a piston rod of the fluid cylinder can be engaged in said recess or bore.

A hold-down device is preferably arranged between the primary tappet and the secondary tappet, wherein said device can be coupled with and decoupled from the secondary tappet.

The coupling of the hold-down device with the secondary tappet is preferably achieved via a second coupling element, which, in particular, is preferably a fluid cylinder and especially preferably a pneumatic cylinder. An electric drive can also be provided in this case.

BRIEF DESCRIPTION OF DRAWINGS

In the following, an example of an embodiment of the invention will be explained in more detail with the aid of a figure: They show.

DETAILED DESCRIPTION

Figure 1:
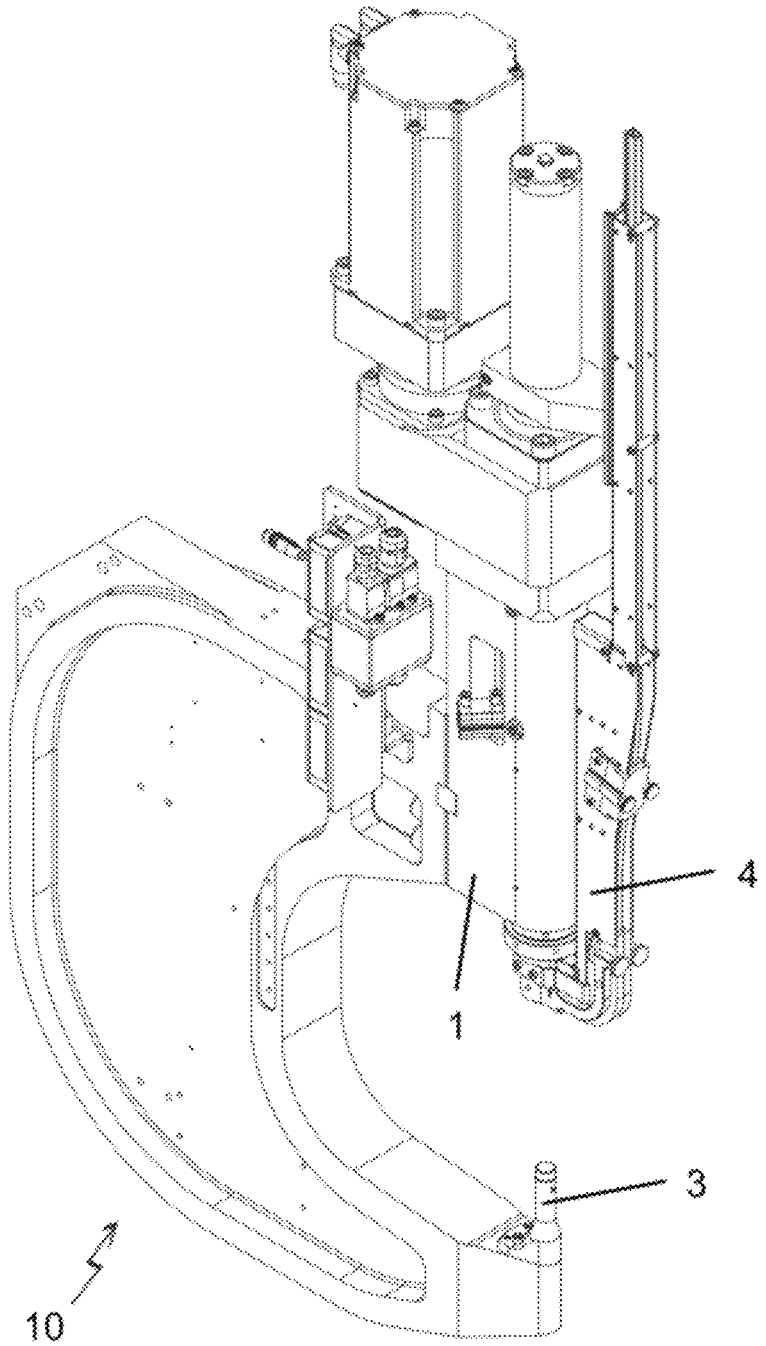
FIG. 1 shows a perspective representation of a joining tool.
Figure 2:
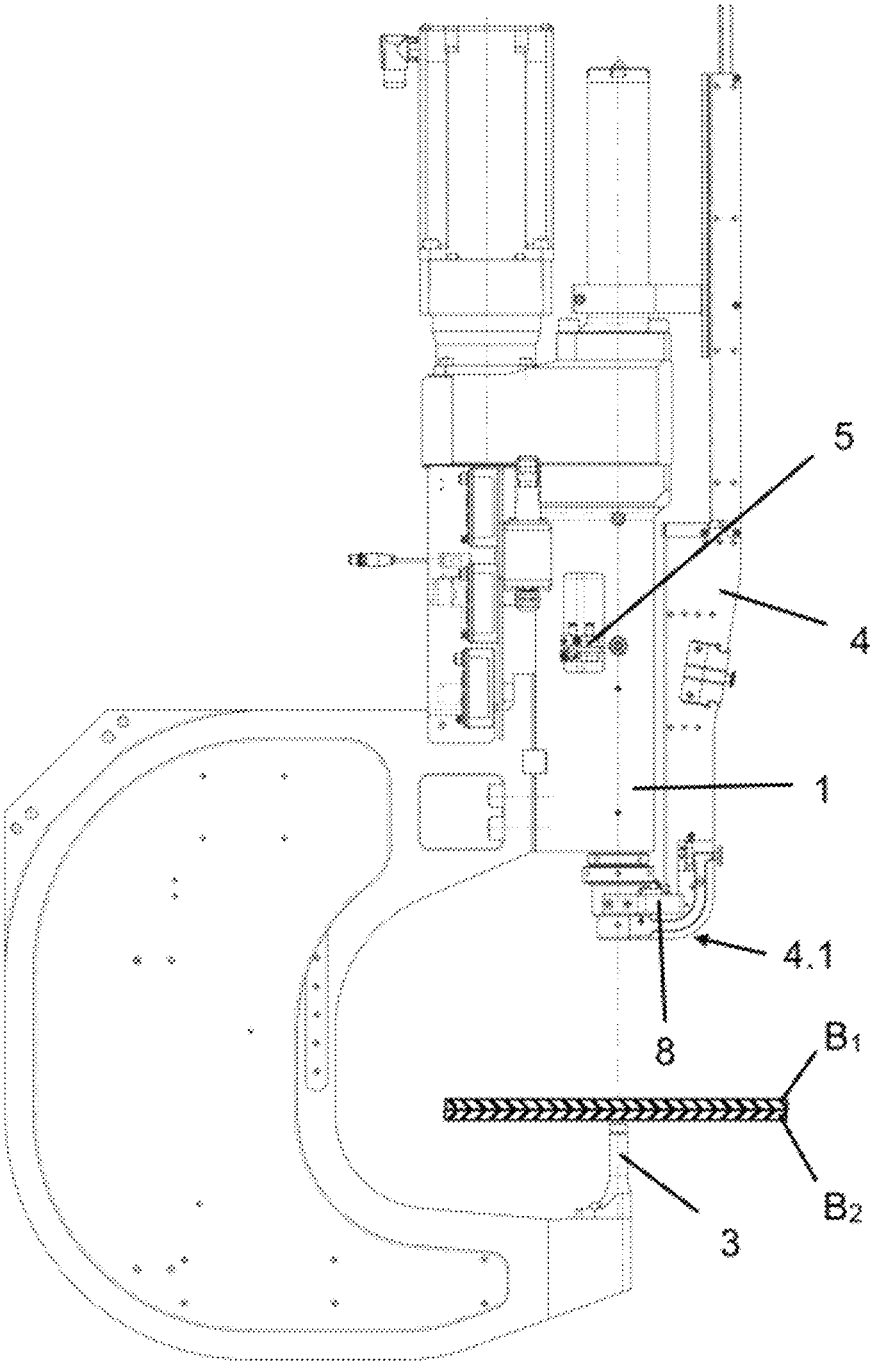
FIG. 2 shows a side view of the joining tool according to FIG. 1.
Figure 3A:
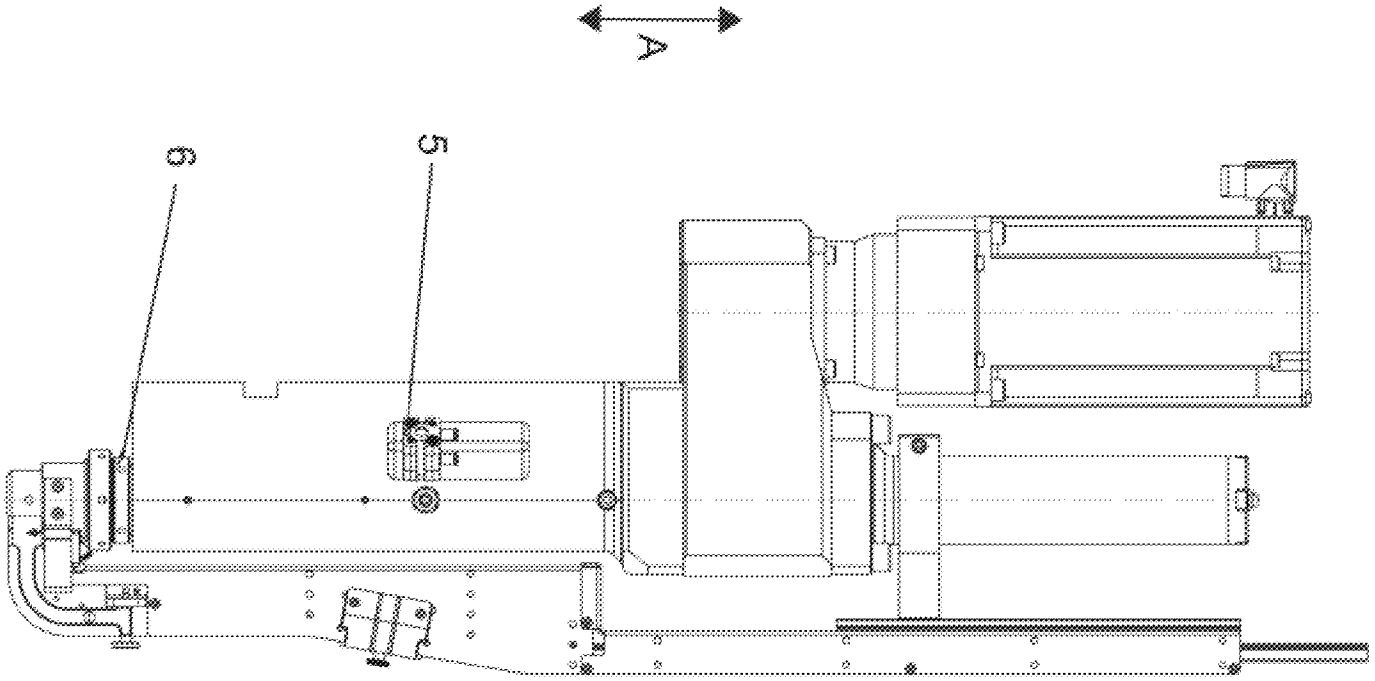
FIG. 3*a* shows a side view of the joining tool with a driven-in primary tappet.
Figure 3B:
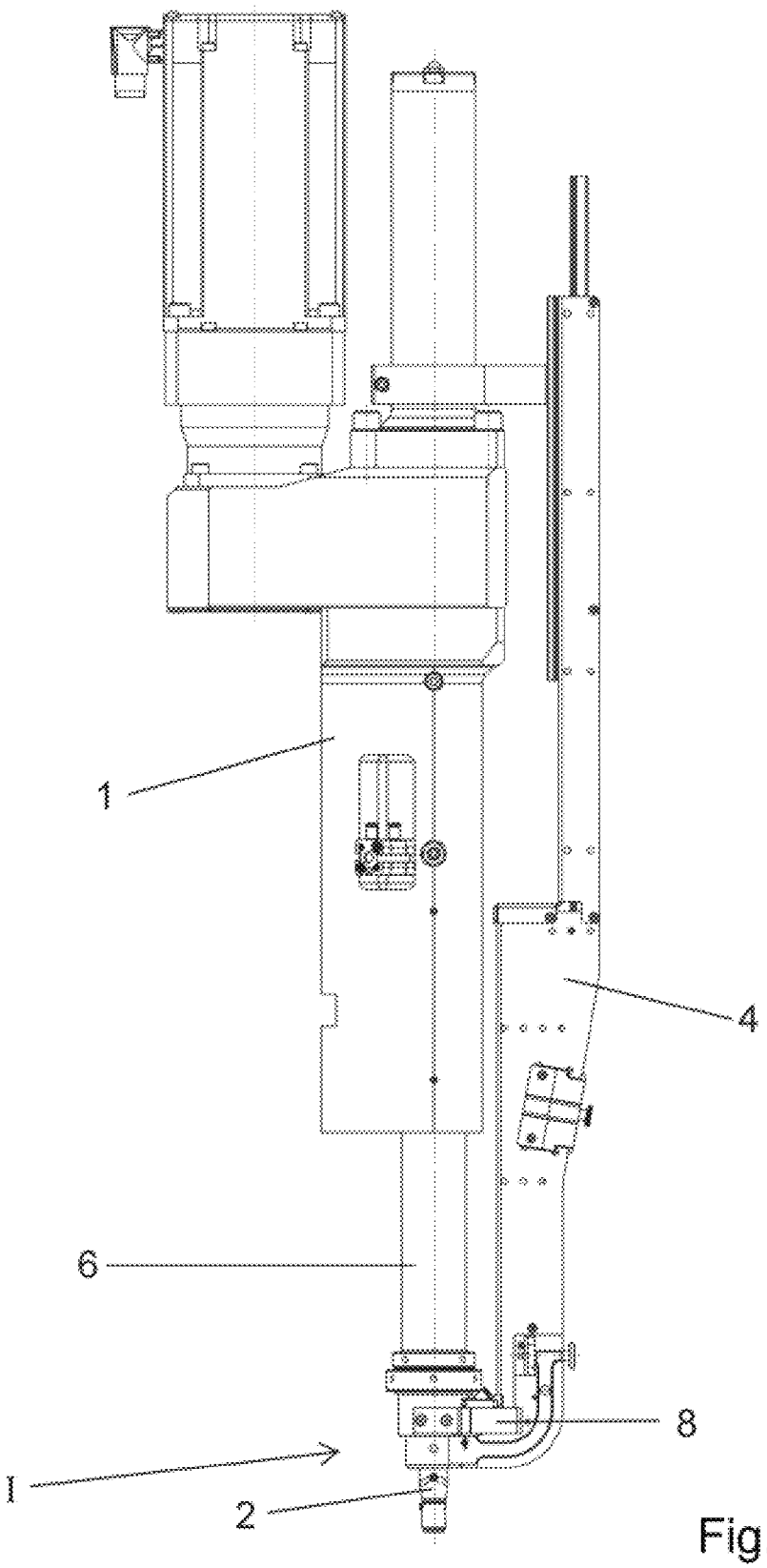
FIG. 3*b* shows a joining tool according to FIG. 3*a* with the element feed that has been displaced with the primary tappet.

The joining tool is composed of the C-shaped bent bracket 10 on whose upper limb the housing 1 is arranged which accommodates the primary tappet 2 consisting of a punch 9 and a hold-down device 7. The die 3 is arranged on the lower limb of the bracket 10, said die extending coaxially to the primary tappet 2. The metal sheets $B_1$, $B_2$ to be joined are arranged between the primary punch 2 and the die 3.

Figure 4A:
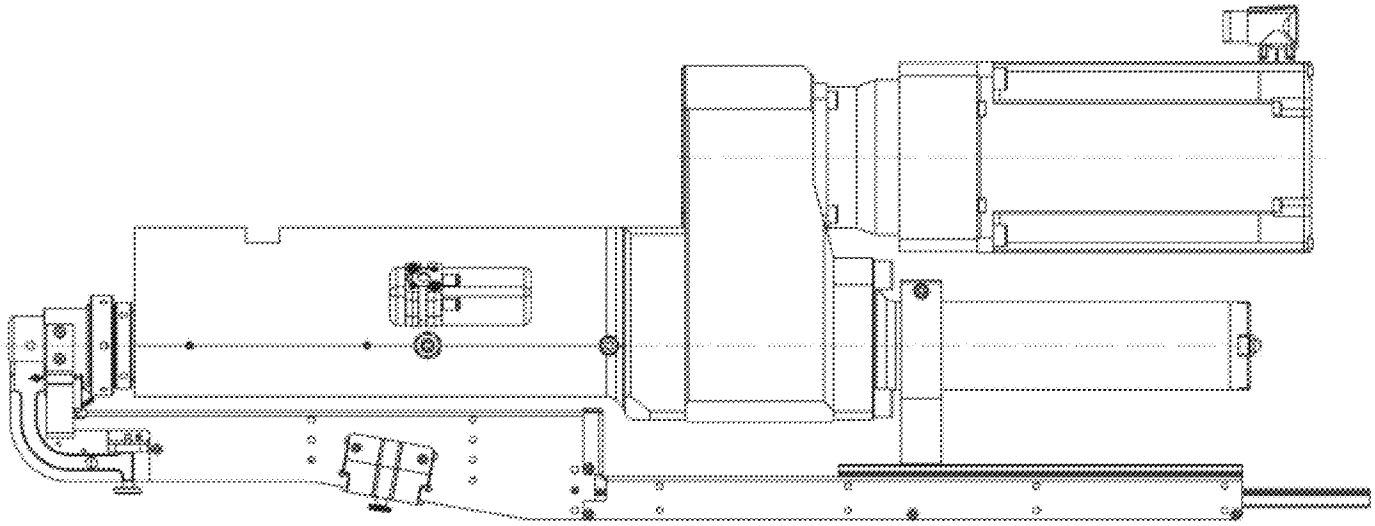
FIG. 4*a* shows the joining tool according to FIG. 3*a;*
Figure 4B:
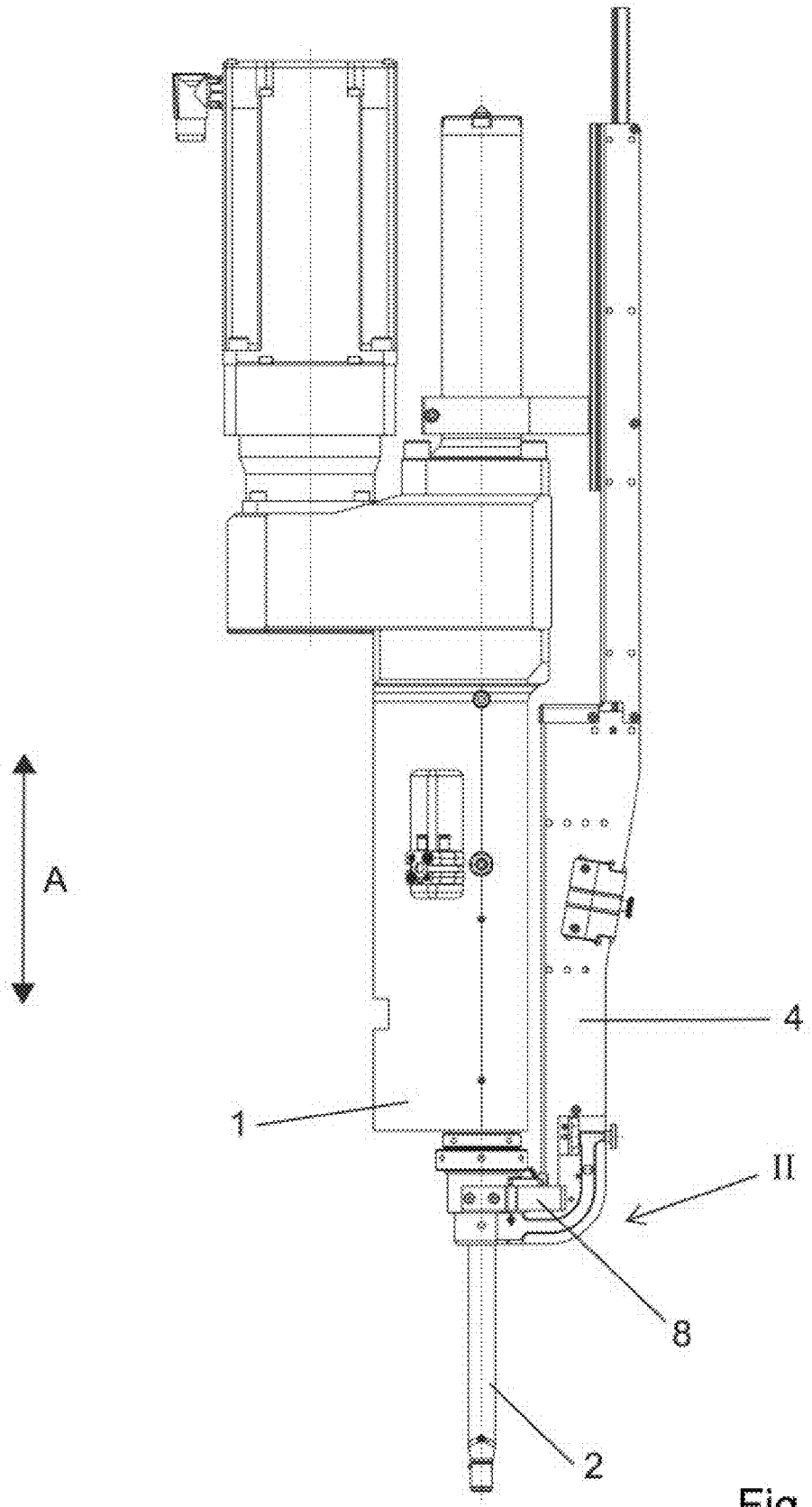
FIG. 4*b* shows the joining tool according to FIG. 4*a* with the element feed immovably arranged on the housing.
Figure 5A:
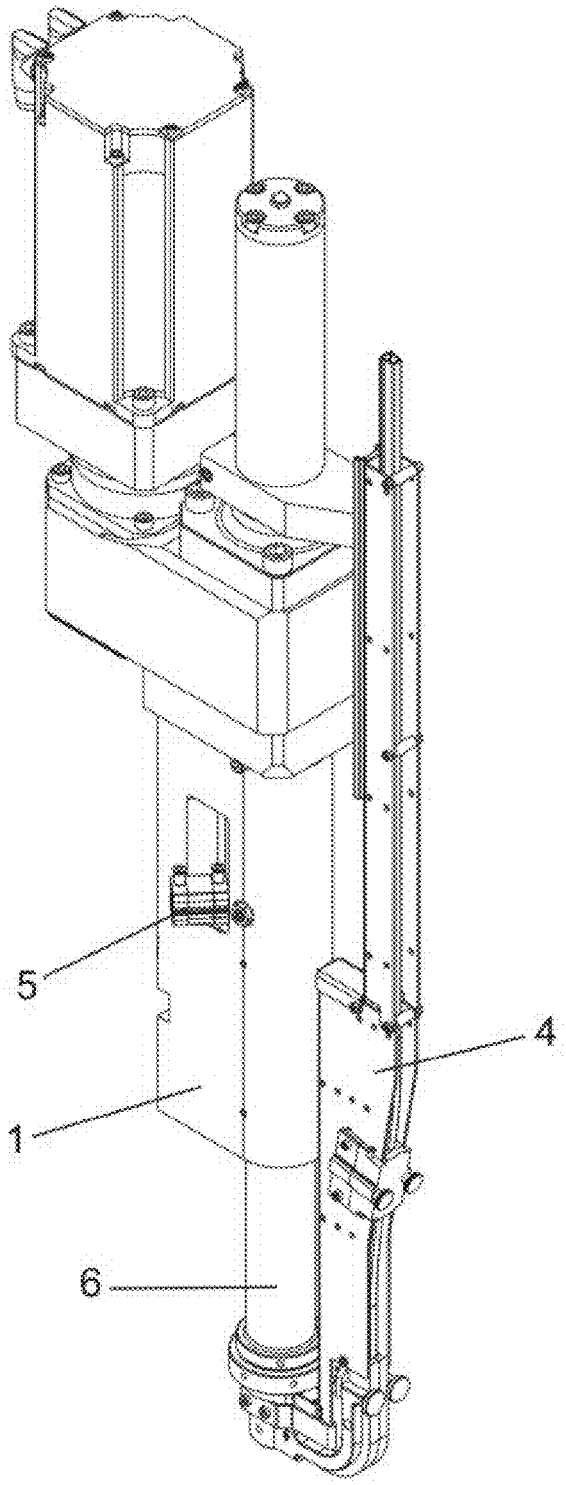
FIG. 5*a* shows a perspective representation of the joining tool with the element feed coupled on the secondary tappet.
Figure 5B:
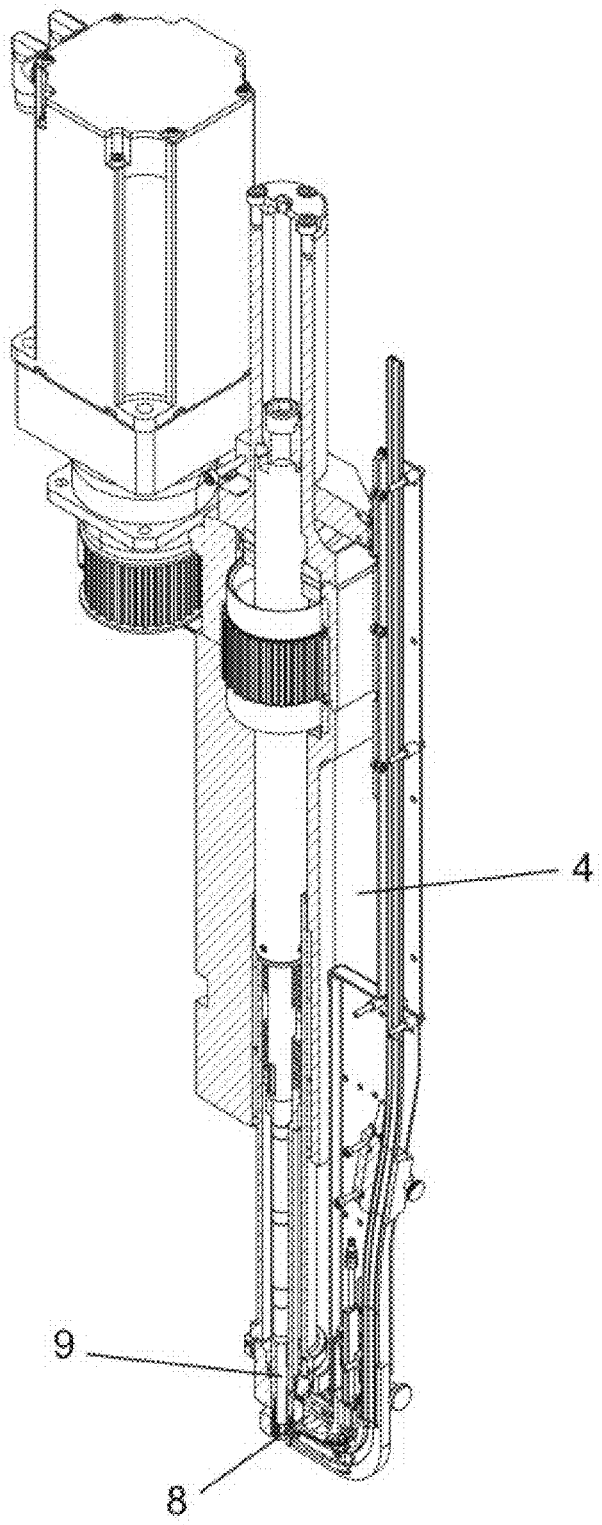
FIG. 5*b* shows a partial longitudinal cut through the joining tool according to FIG. 5*a;*
Figure 6A:
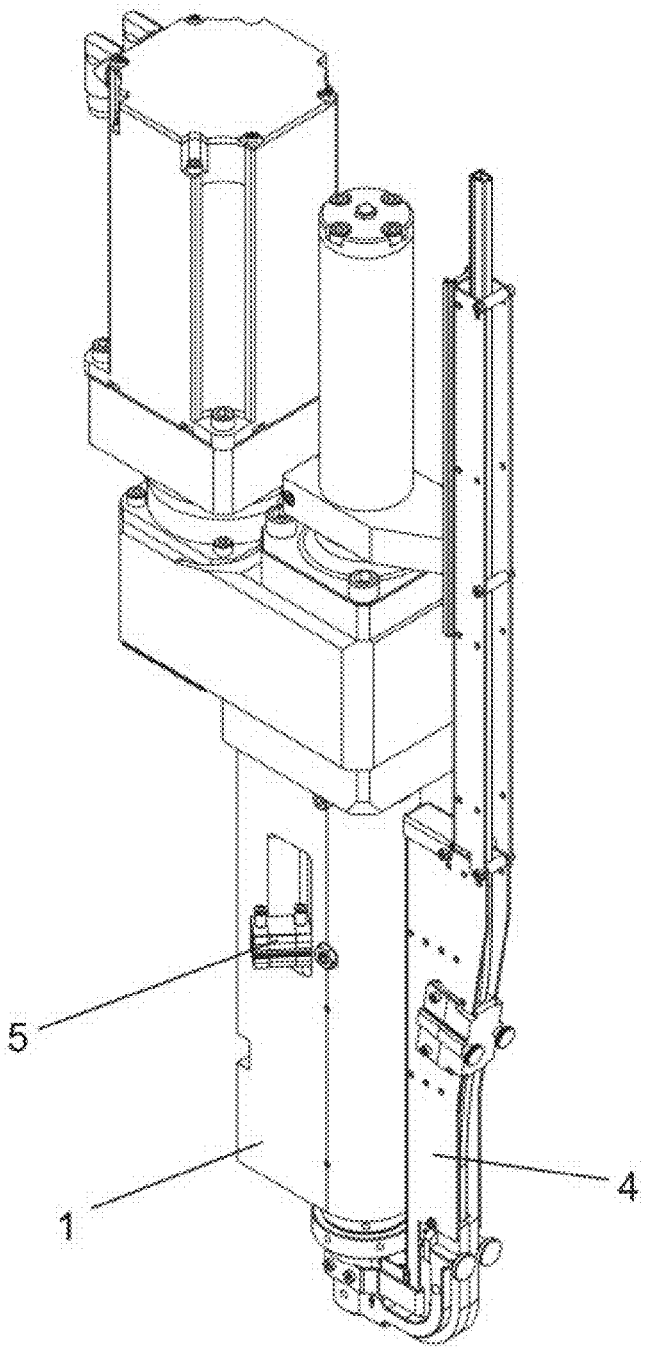
FIG. 6*a* shows a perspective representation of the joining tool with the immovably arranged element feed.
Figure 6B:
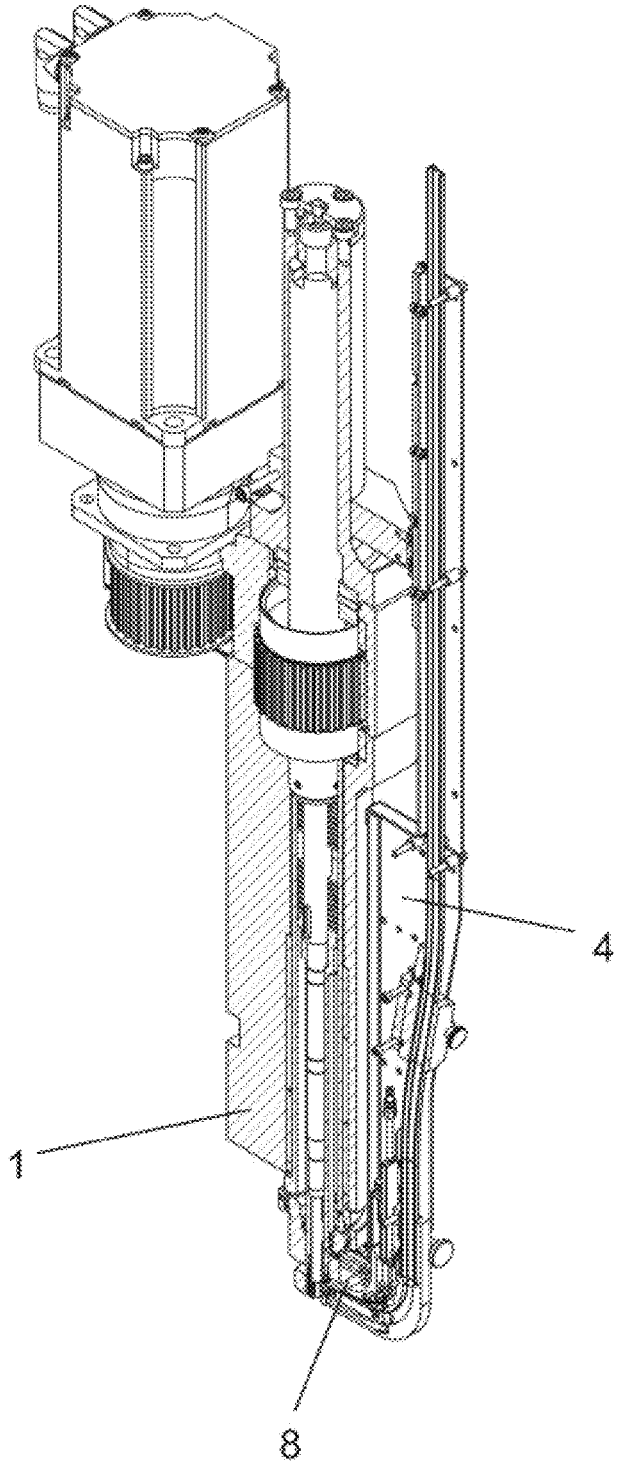
FIG. 6*b* shows a partial cut through the joining tool according to FIG. 5*a;*
Figure 7:
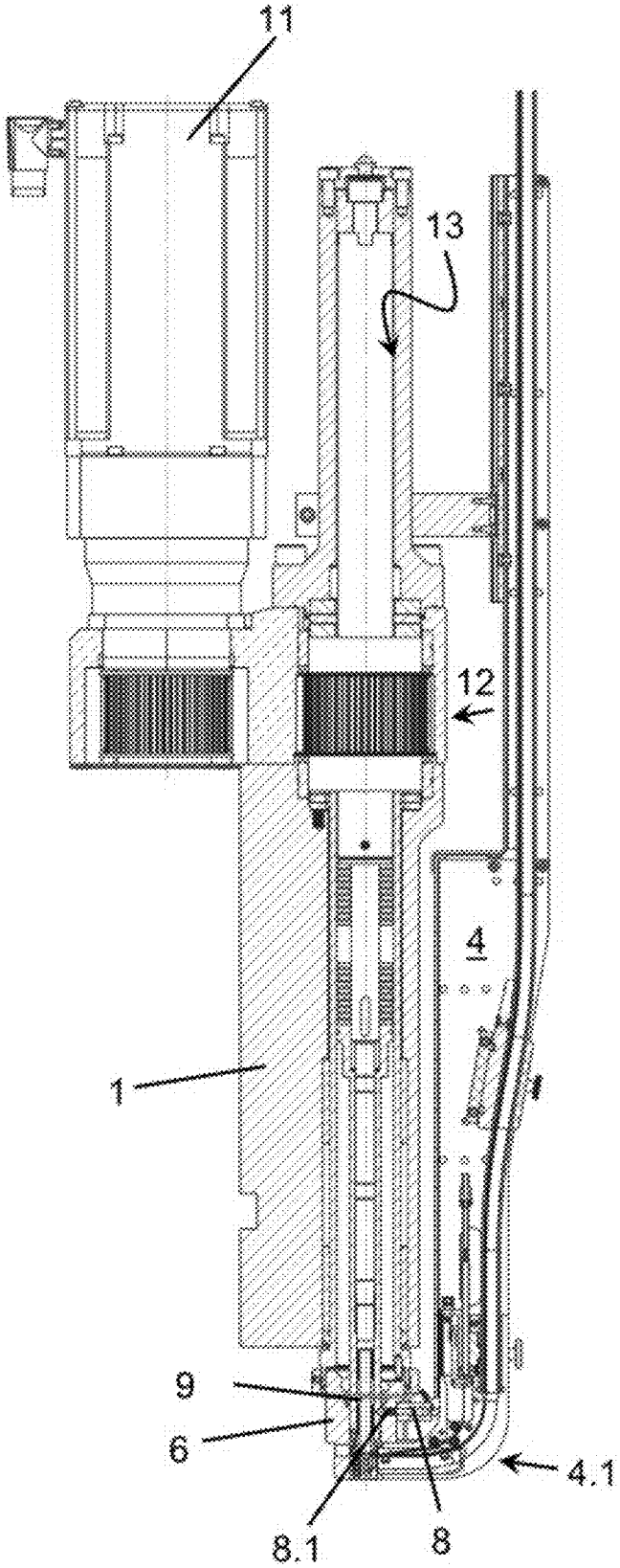
FIG. 7 shows an enlarged representation of the cut according to FIG. 6*b;*
Figure 8A:
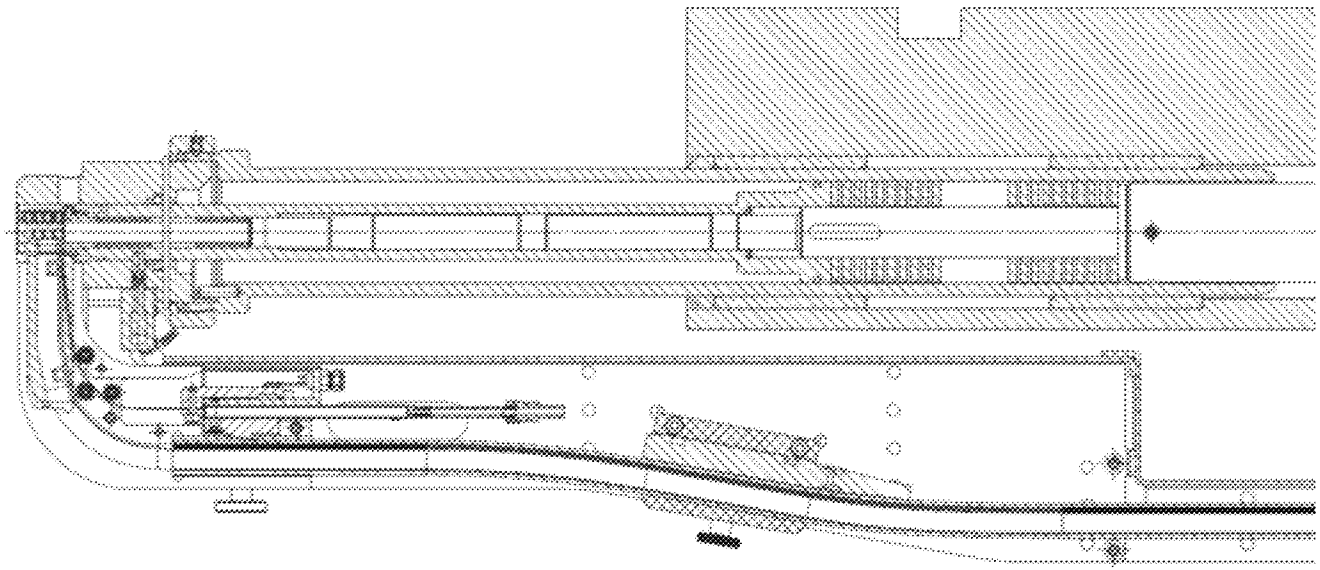
FIG. 8*a* shows a longitudinal cut through the joining tool with the primary punch in its upper position.
Figure 8B:
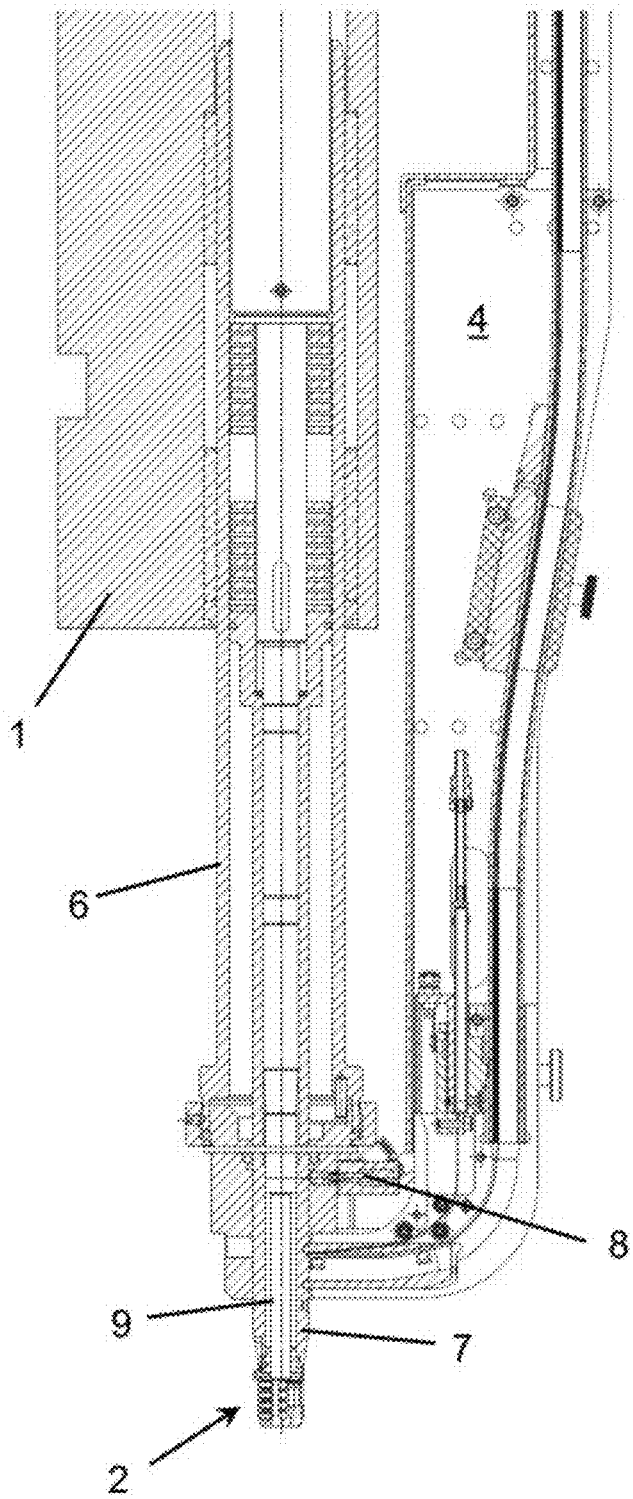
FIG. 8*b* shows a cut according to FIG. 8*a* with the primary tappet in a lower position.
Figure 9A:
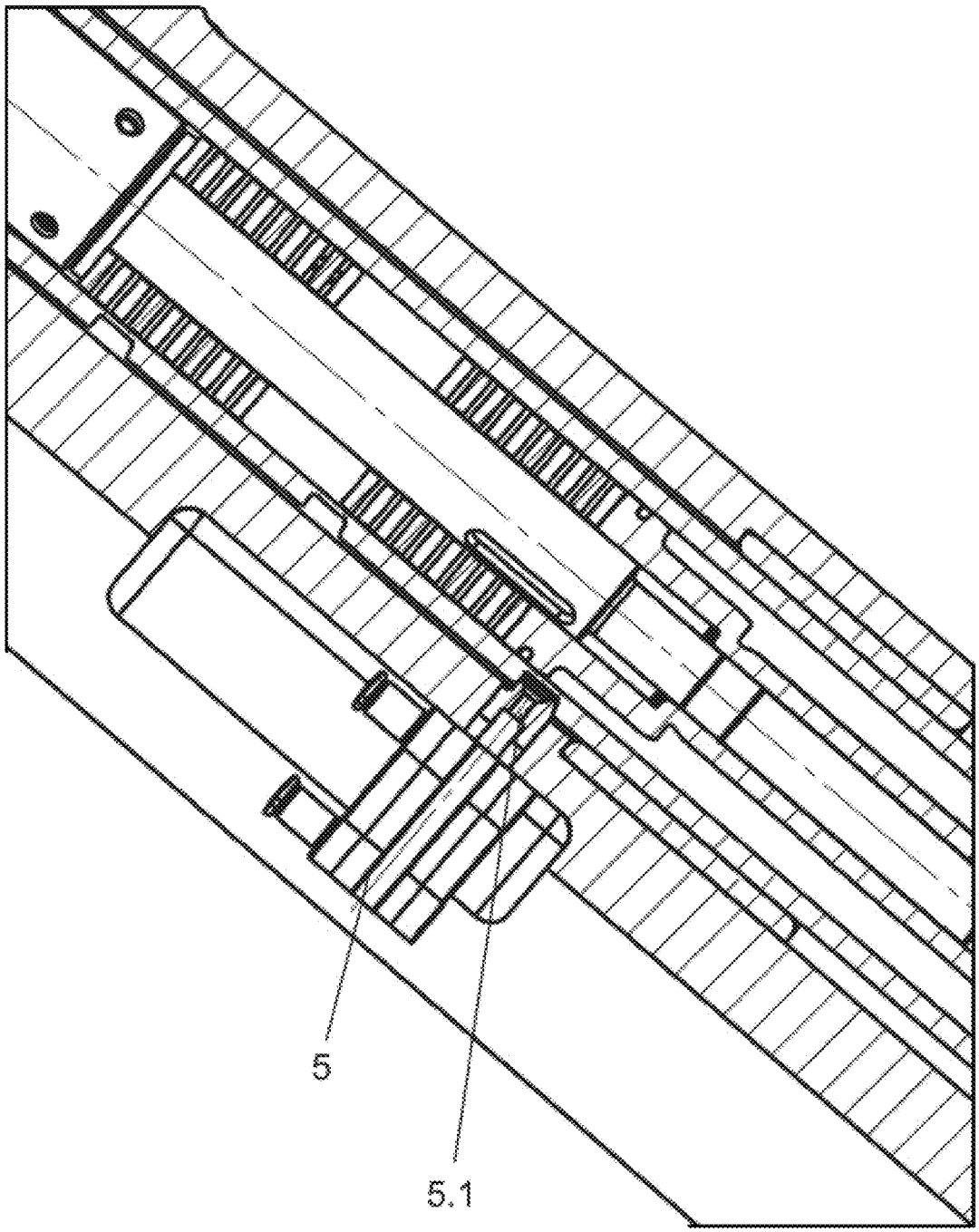
FIG. 9*a* shows a perspective representation of the joining tool.
Figure 9B:
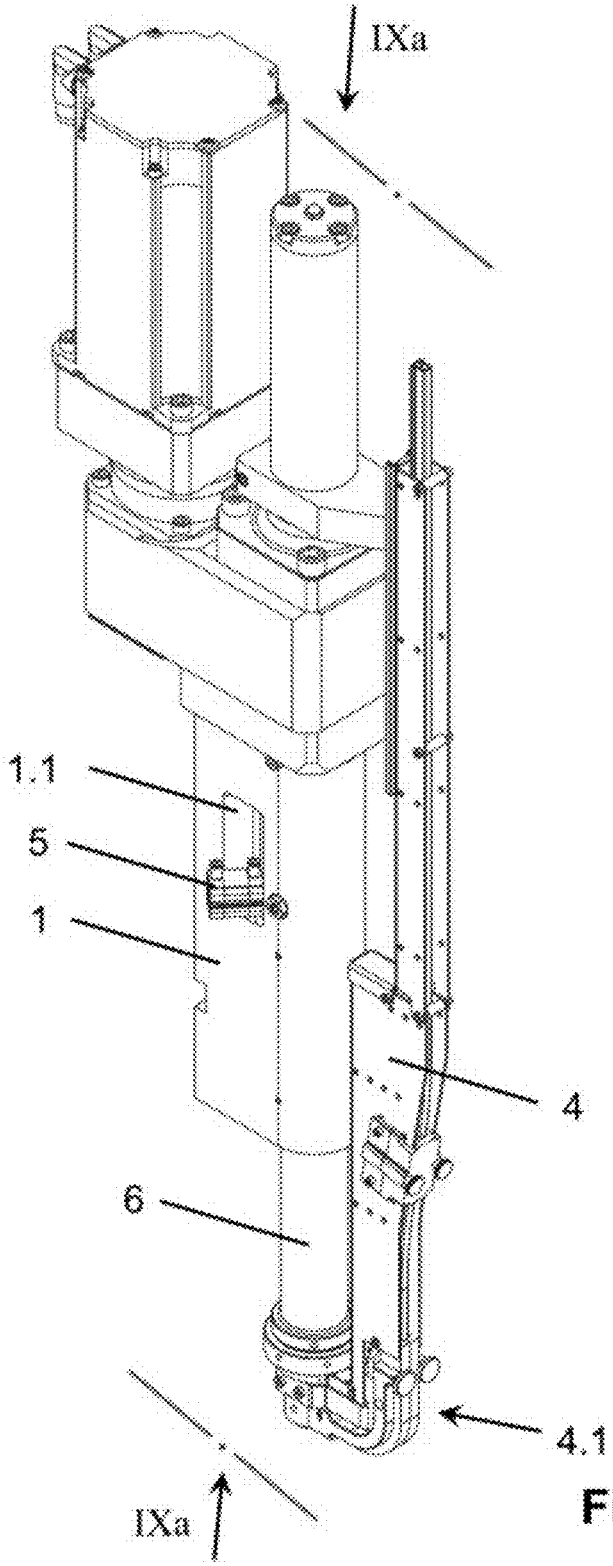
FIG. 9*b* shows a cut along the line IXa-IXa in a partial representation.
Figure 10A:
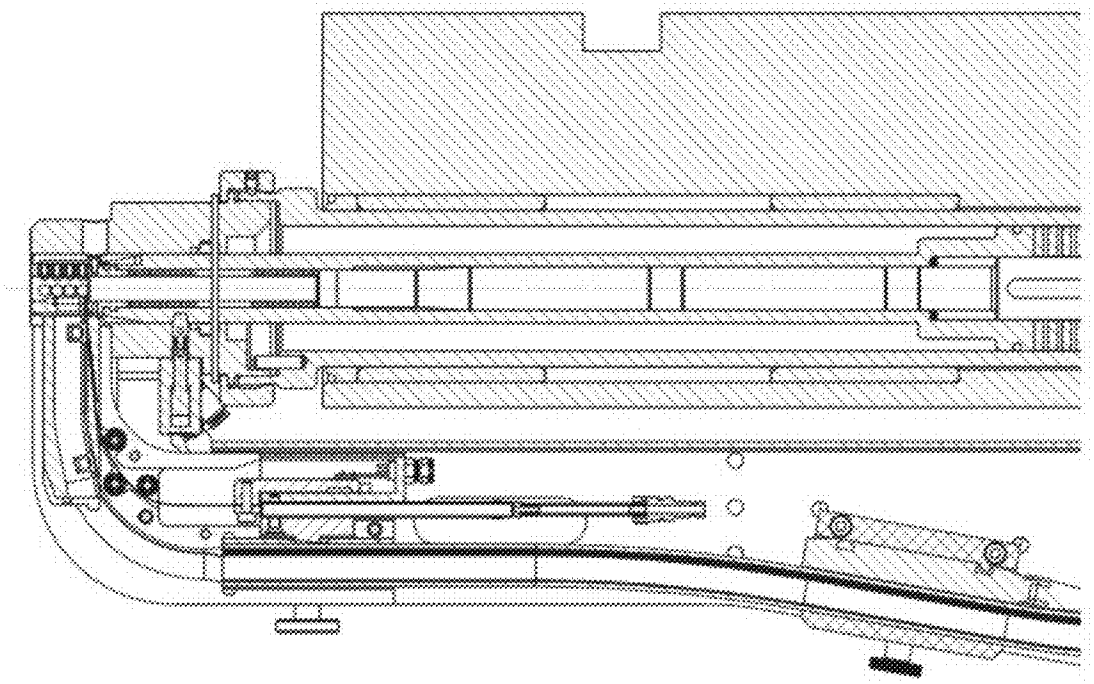
FIG. 10*a* shows a representation corresponding to FIG. 8*a;*
Figure 10B:
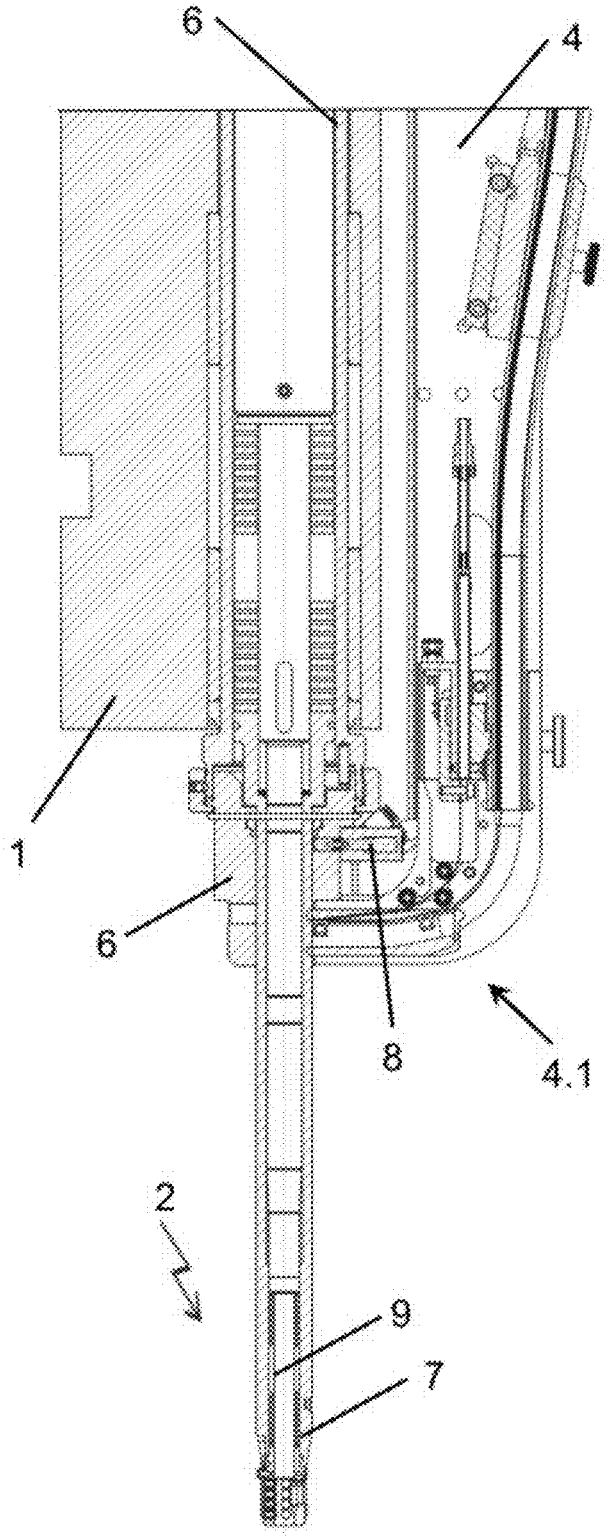
FIG. 10*b* shows a representation corresponding to FIG. 8*b* with a further extended punch.
Figure 11:
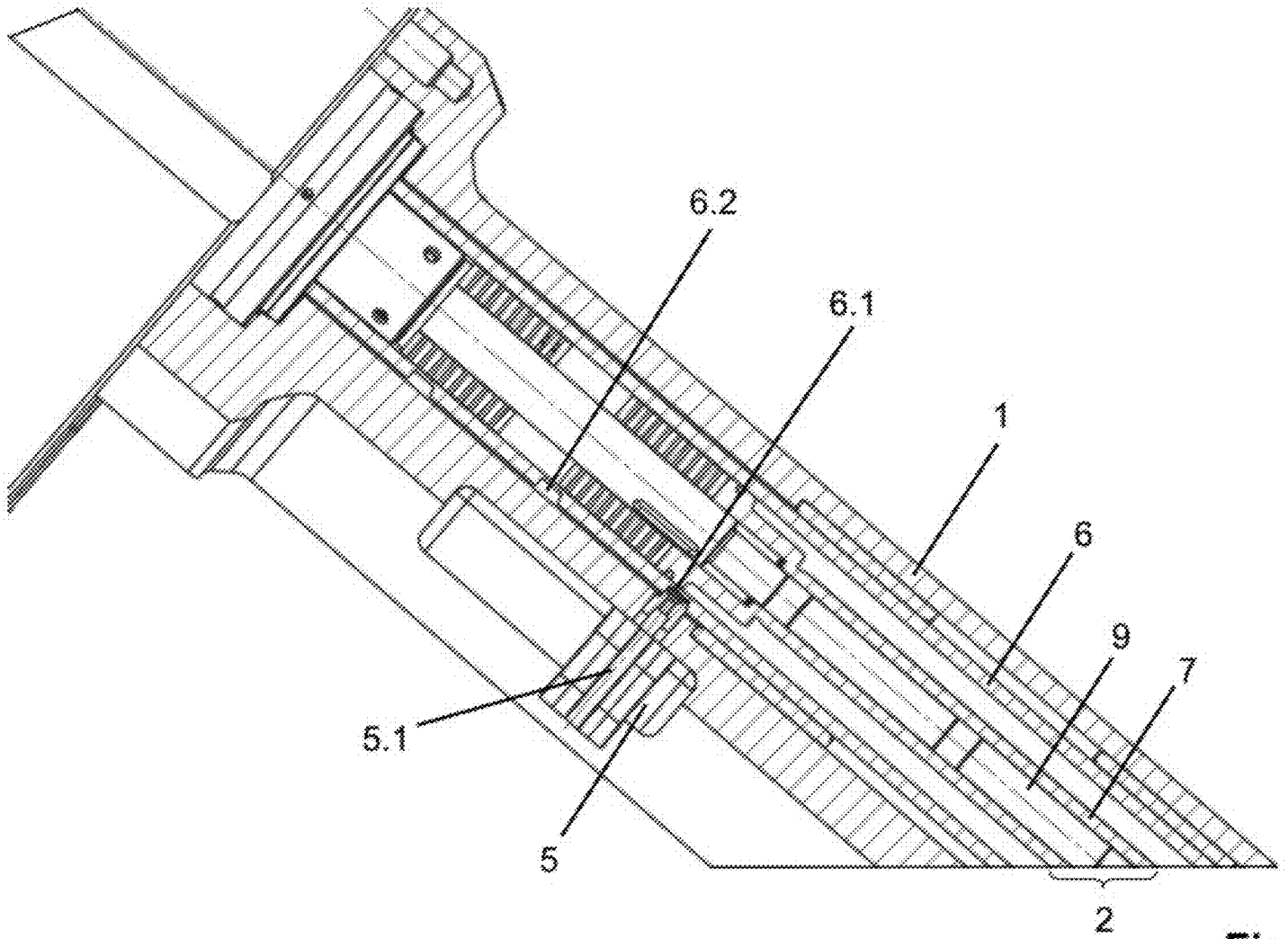
FIG. 11 shows an enlarged representation of FIG. 9*a;*

For example, FIG. 4 depicts the structure of the upper tool part. The electric motor 11 serves to drive the tool. Via a toothed belt drive 12 and a roller screw drive 13, not shown in detail, with an anti-rotation device in the housing 1, the rotation initiated by the electric motor 11 is converted into an axial movement of the punch 9. The punch 9 is coaxially surrounded by the hold-down device 7, which in turn is arranged coaxially inside a secondary tappet 6. The secondary tappet 6 can either be immovably fixed in its position in the housing 1 or it can carry out the drive movement in the axial direction A of the punch 9 or hold-down device 7 and primary tappet 2.

The element feeder 4.1 of the element feed 4 is located at the free end of the secondary tappet 6, which is assigned to the die 3, and can be fixed to or detached from the hold-down device 7 via the coupling element 8. The coupling element 8 is preferably a pneumatic cylinder, which can engage with its piston rod in a bore or recess provided in the hold-down device 7. If the piston rod is driven into the recess, the element feed 4 is coupled with the hold-down device 7. If the piston rod is driven into the pneumatic cylinder, the element feed 4 is decoupled from the hold-down device 7. A further coupling element 5 is arranged in a recess 1.1 provided in the housing 1, said coupling element also preferably being designed as a pneumatic cylinder. By way of its piston rod 5.1, this pneumatic cylinder 5 interacts with several recesses or bores 6.1, 6.2 provided in the upper part of the secondary tappet 6 guided in the housing 1. If the piston rod 5.1 is immersed in one of the bores 6.1, 6.2, the secondary tappet 6 is fixed within the housing 1 such that the upper position of the secondary tappet 6 and thus its distance from the die 3 is fixed. If the coupling element 5 is deactivated, i.e. the piston rod 5.1 of the pneumatic cylinder 5 is disengaged from the secondary tappet 6, the element feed 4 can be driven with the primary tappet 2 in the direction of the die 3. If the coupling element 8 is activated, the element feed 4 is coupled with the hold-down device 7, so that neither remains stationary in relation to the housing 1; rather, they are axially displaced with the primary tappet 2 and the rivet that was previously taken up in the direction of the die 3 in order to penetrate into the metal sheets $B_1$, $B_2$ and join them together by means of the auxiliary joining part. Rather than using a pneumatic cylinder for the coupling elements 5 and 8, the drive of a pin (piston rod) that is inserted into the recesses or bores can also be carried out by an electric drive.

Figure 12A:
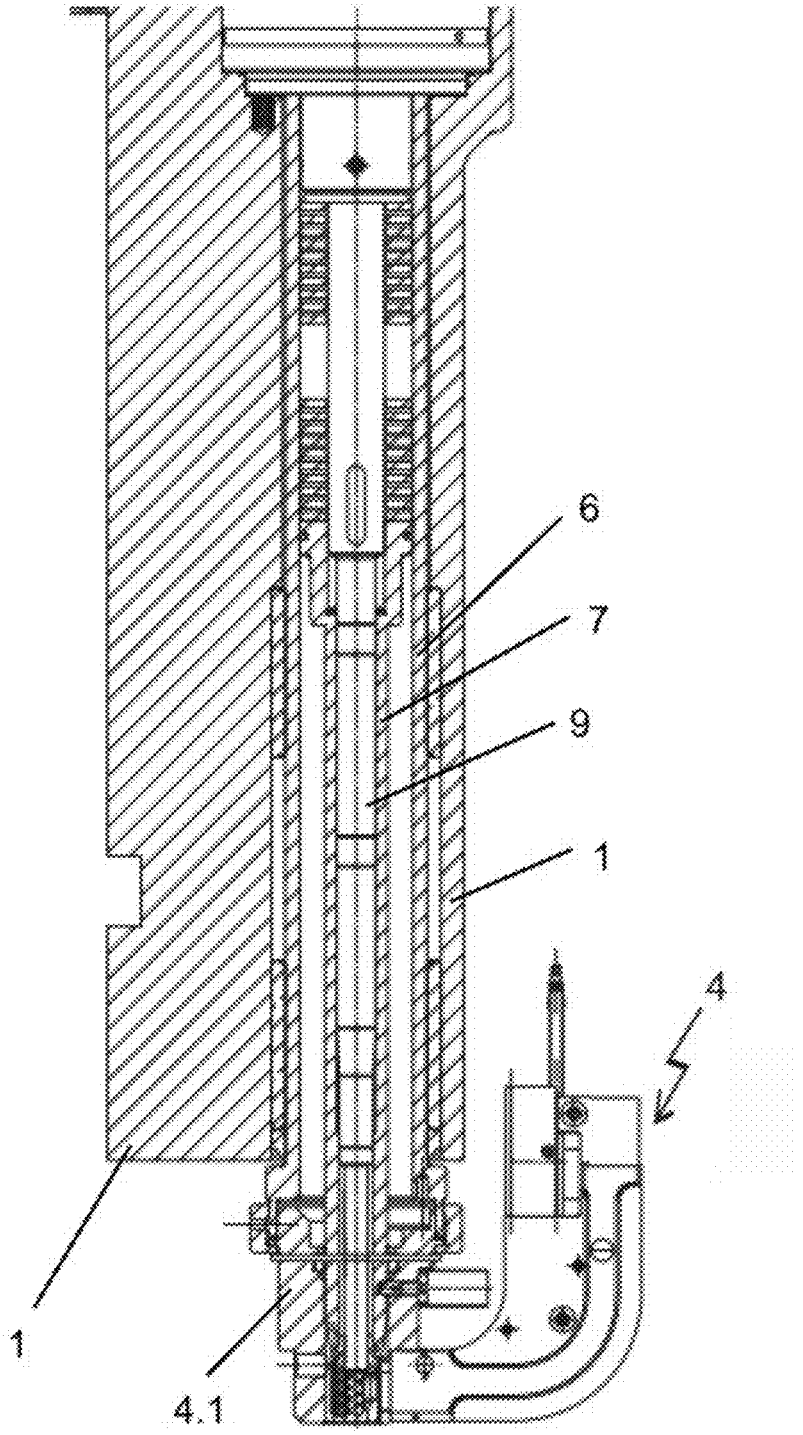
FIG. 12*a* shows a further partial cut.
Figure 12B:
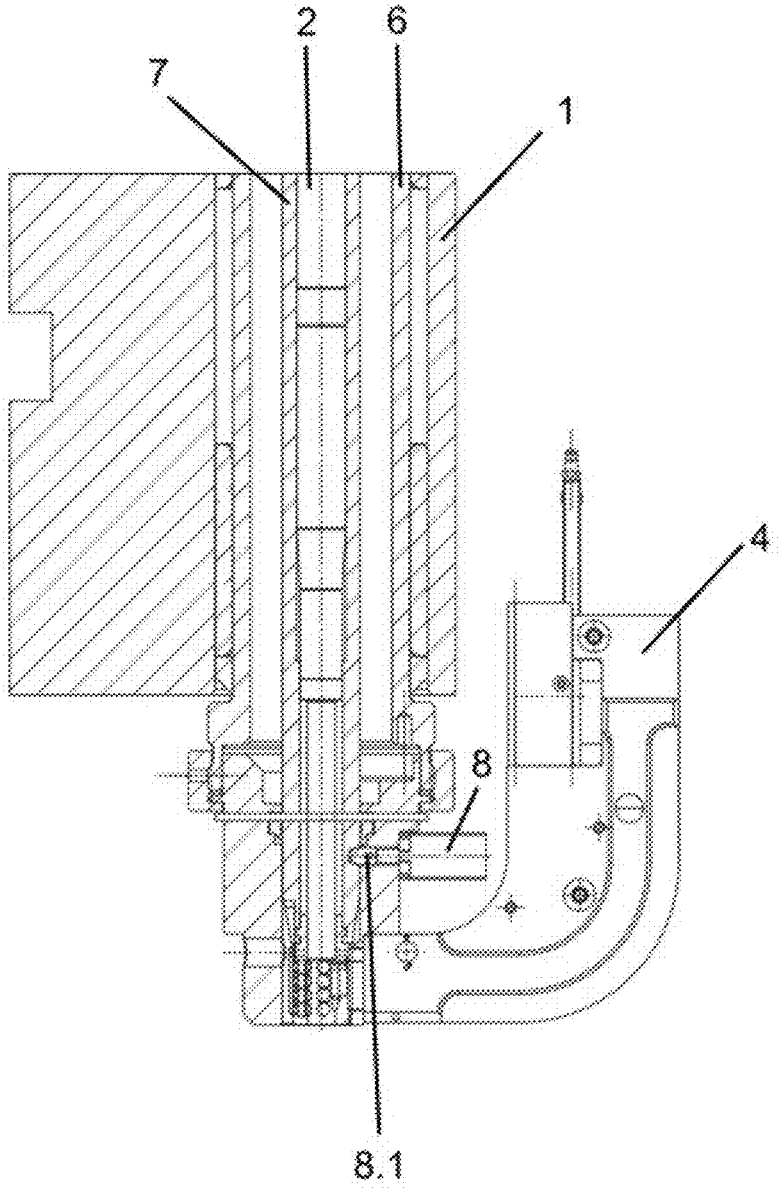
FIG. 12*b* shows an enlarged section from FIG. 12*a;*
Figure 13A:
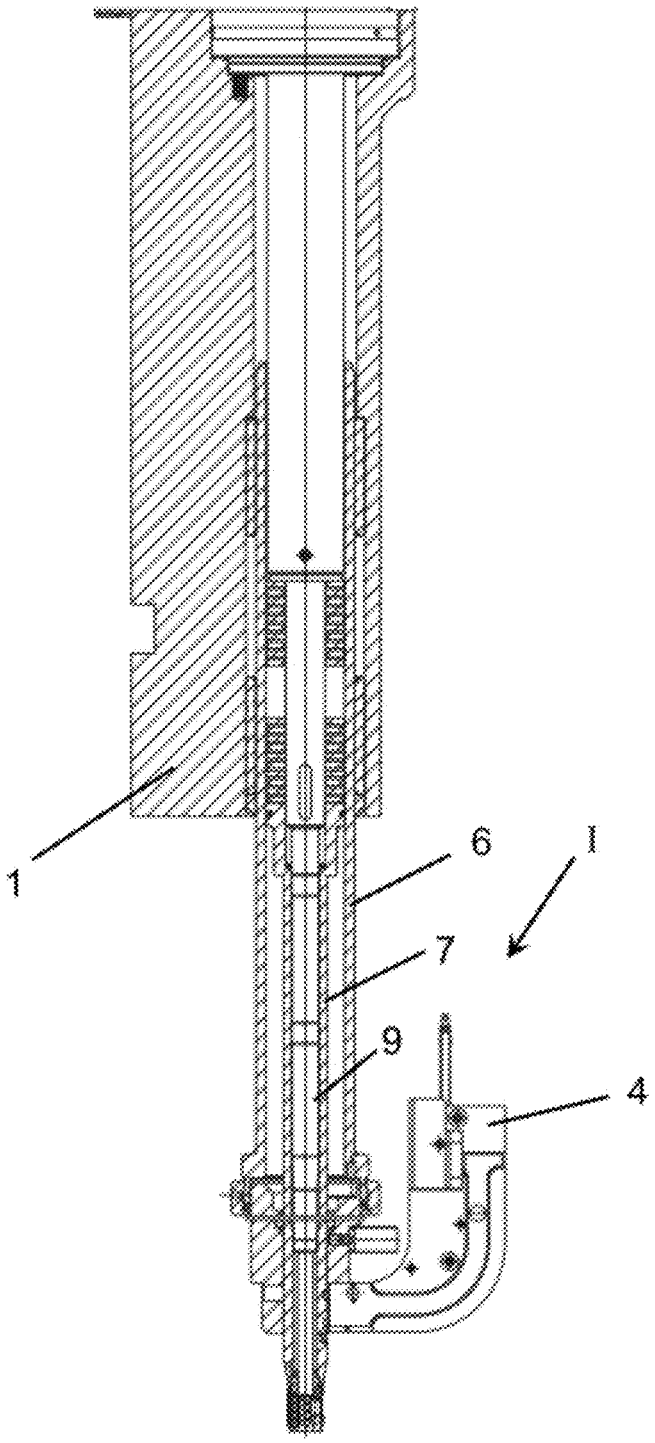
FIG. 13*a* shows a further partial cut.
Figure 13B:
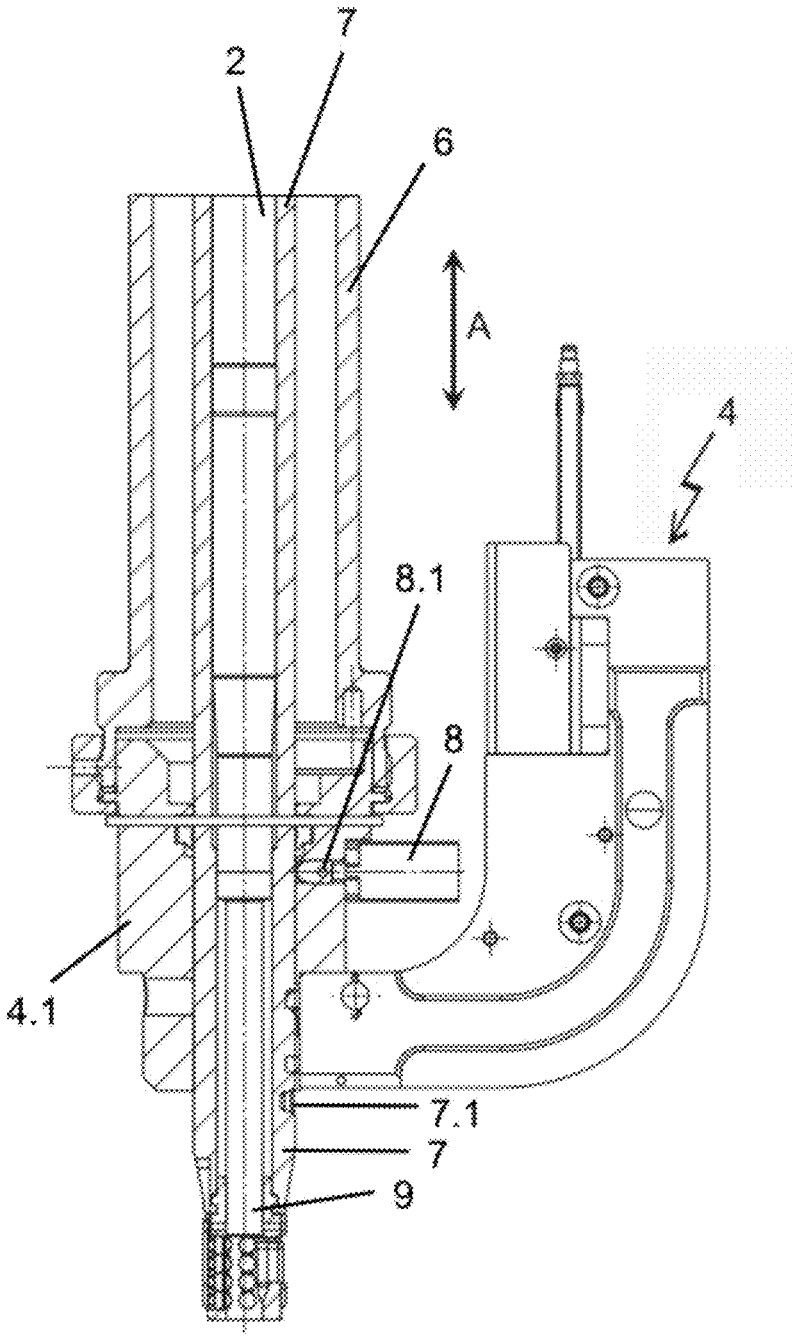
FIG. 13*b* shows the enlargement of a detail according to FIG. 13*a;*
Figure 14A:
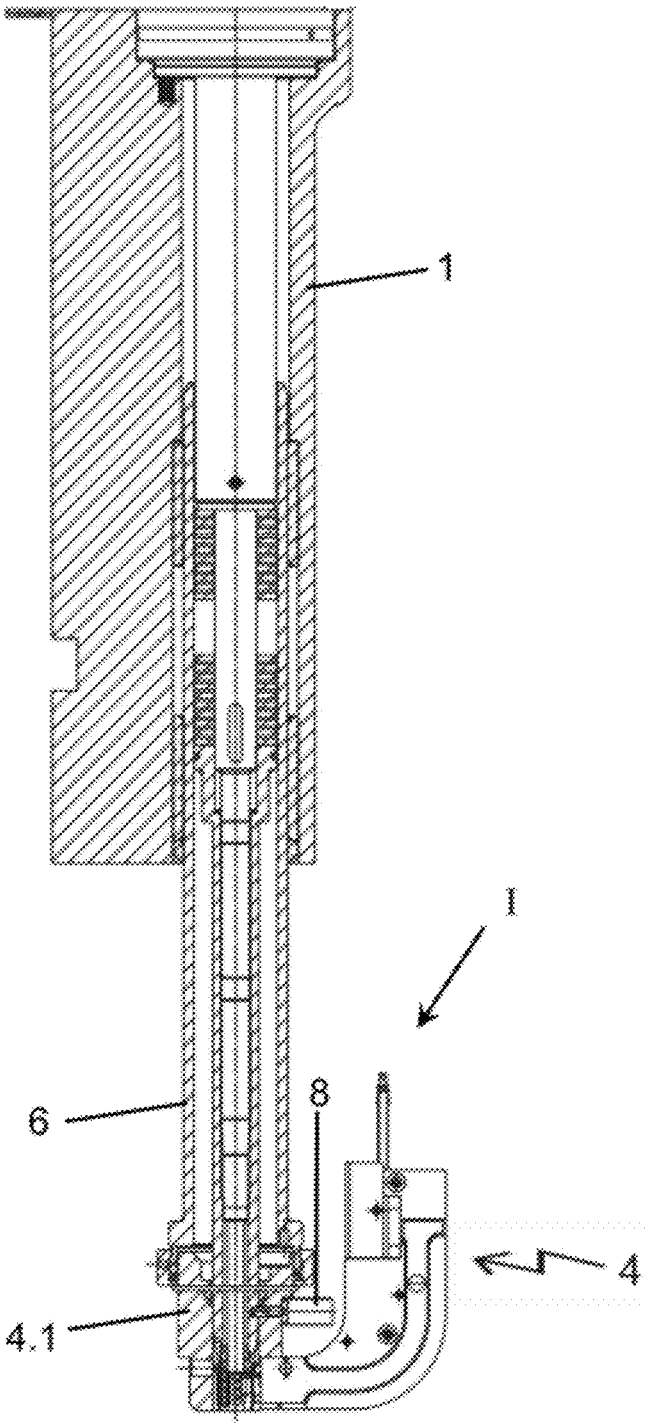
FIG. 14*a* shows a further partial cut.
Figure 14B:
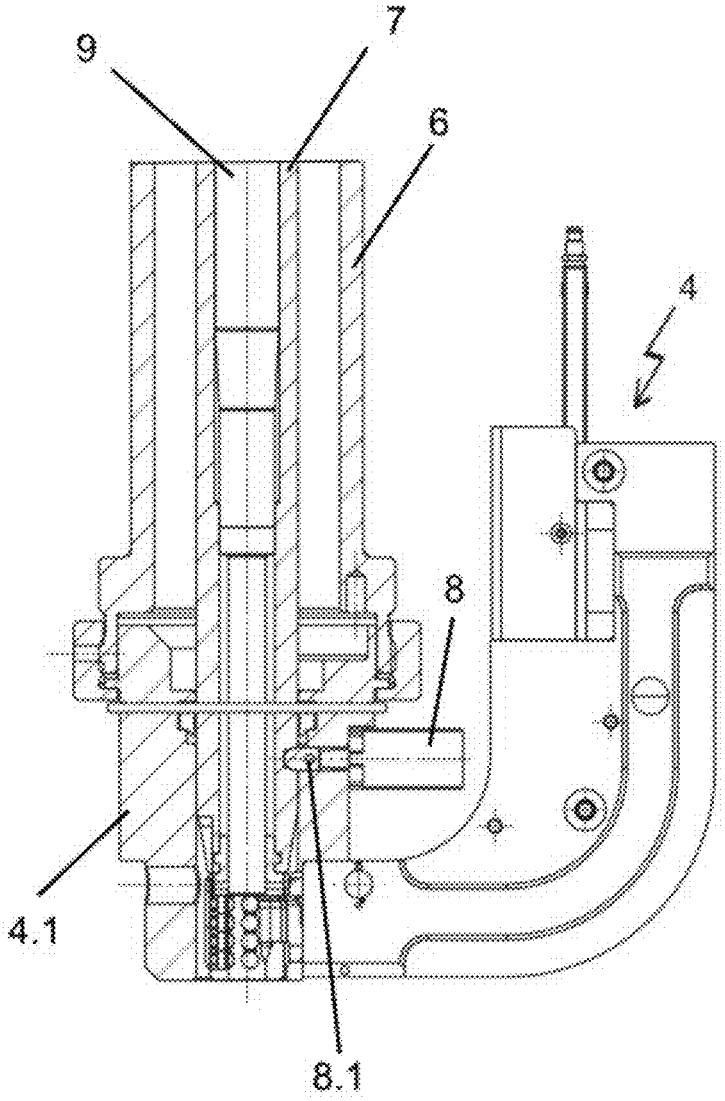
FIG. 14*b* shows the enlargement of a detail according to FIG. 14*a;*
Figure 15A:
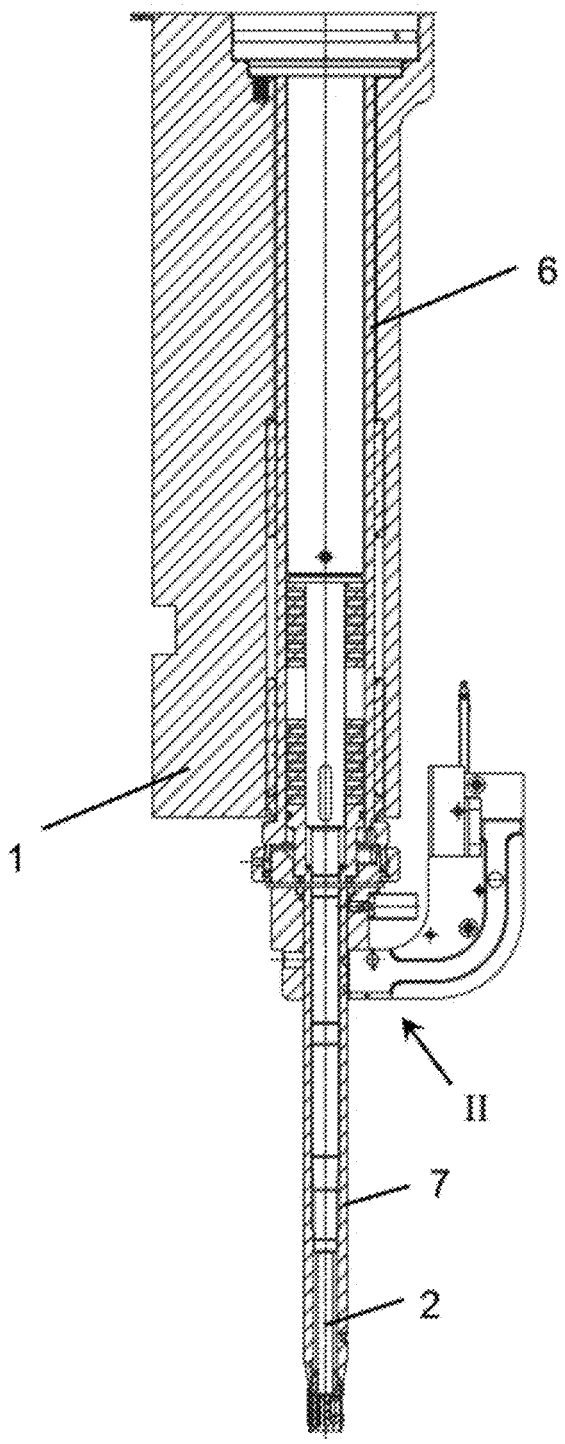
FIG. 15*a* shows a further partial cut.
Figure 15B:
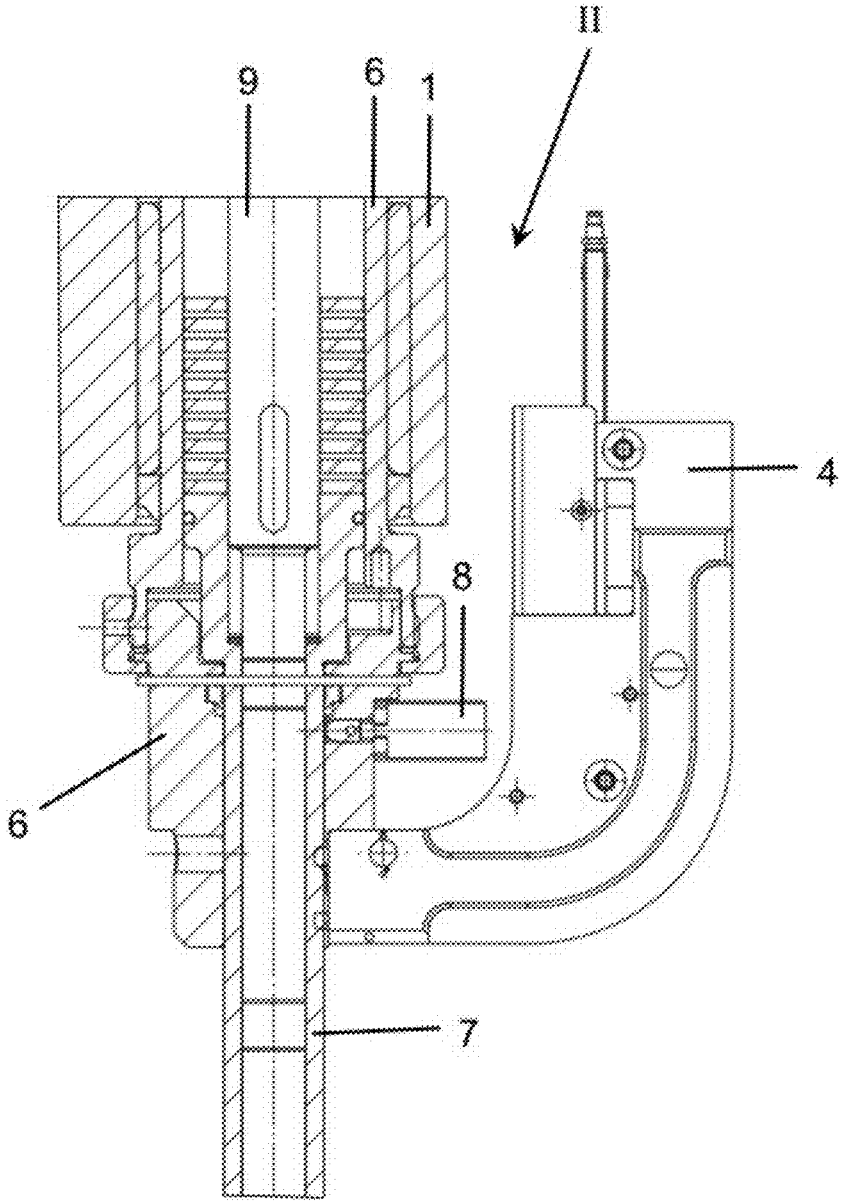
FIG. 15*b* shows the enlargement of a detail according to FIG. 15*a.*

The movements of the secondary tappet 6 and the primary tappet 1 that can be executed in the axial direction A can be conducted collectively, as described in the following, or by the primary tappet 2 only:

As is clear from FIG. 13*b*, for instance, the element feeder 4.1 of the element feed 4 is securely attached to the lower end of the secondary tappet 6. A pneumatic cylinder 8 is provided at the side of the element feeder 4.1, the piston rod 8.1 of which is guided in a bore provided radially in the element feeder 4.1. The piston rod 8.1 can interact with a radial recess 7.1 provided in the hold-down device 7. When the piston rod 8.1 engages in the recess 7.1 (cf. FIG. 12*a*), the element feed 4 is joined with the hold-down device 7. At the same time, the piston rod 5.1 of the pneumatic cylinder 5 must be removed from the bore 6.1 or 6.2 of the secondary tappet 6, i.e. the pneumatic cylinder 5 must be deactivated. If the tappet 2 is now driven, the element feed 4 moves with the hold-down device 7 in direction of the die 3, as shown in FIGS. 14*a*, 14*b*. If the pneumatic cylinder 8 is deactivated and the piston rod 8.1 driven out of the recess 7.1, the element feed 4 is no longer coupled with the hold-down device 7 via its element feeder 4.1. If the pneumatic cylinder 5 is then activated and its piston rod 5.1 inserted into one of the bores 6.1, 6.2, the secondary tappet 6 is fixed in the housing 1 and cannot follow the hold-down device 7 and thus the punch 9. The element feed 4 is therefore not moved in the direction of the die 3 and sufficient access space to the components (metal sheets B1, B2) is ensured. The position of the bores 6.1, 6.2 determines the fixed position of the element feed 4 in relation to the die 3 and therefore the size of the access space to the workpieces B1, B2 that are to be joined together.

The invention claimed is:

1. A tool for joining components with a housing, in which a primary tappet composed of a punch and a hold-down device is mounted such that it can be driven in an axial direction (A), a die assigned to the punch and an element feed that can be moved in the axial direction relative to the housing, via which auxiliary joining parts can be fed to the primary tappet, wherein at least one position coupled at least indirectly to the primary tappet and at least one position decoupled from the primary tappet can be assumed by the element feed, and the element feed can be moved in the coupled position together with the primary tappet in the axial direction and remains stationary relative to the housing in the decoupled position upon a movement of the primary tappet, wherein the primary tappet is surrounded by a secondary tappet, to which the element feed is fixed.

2. The tool according to claim 1, wherein the coupling of the element feed with the primary tappet is achieved by way of a first coupling element.

3. The tool according to claim 2, wherein the first coupling element is a fluid cylinder.

4. The tool according to claim 3, wherein the fluid cylinder is a pneumatic cylinder.

5. The tool according to claim 1, wherein the secondary tappet can be moved together with the primary tappet in the axial direction (A).

6. The tool according to claim 1, wherein the secondary tappet can be fixed in the housing while the primary tappet moves in the axial direction.

7. The tool according to claim 6, wherein the secondary tappet can be fixed in the housing in at least two different axial positions.

8. The tool according to claim 6, wherein at least one radial recess or bore is provided for fixing purposes in the secondary tappet.

9. The tool according to claim 8, wherein a piston rod of a fluid cylinder can be engaged with the recess or bore.

10. The tool according to claim 1, wherein the hold-down device is arranged coaxially between the primary tappet and the secondary tappet, wherein said hold-down device can be coupled with and decoupled from the secondary tappet.

11. The tool according to claim 10, wherein the coupling of the hold-down device with the secondary tappet is achieved by way of a first coupling element.

12. The tool according to claim 11, wherein the first coupling element is a fluid cylinder.

13. The tool according to claim 12, wherein the fluid cylinder is a pneumatic cylinder.

14. The tool according to claim 1, wherein the auxiliary joining parts are rivets.

15. The tool according to claim 1, wherein the joining components comprise at least two metal sheets lying flat on top of each other.

16. The tool according to claim 1, wherein the element feed is fixed to or detached from the hold-down device via a coupling element that engages and disengages the hold-down device.

17. A tool for joining components with a housing, in which a primary tappet composed of a punch and a hold-down device is mounted such that it can be driven in an axial direction (A), a die assigned to the punch and an element feed that can be moved in the axial direction relative to the housing, via which auxiliary joining parts can be fed to the primary tappet, wherein at least one position coupled at least indirectly to the primary tappet and at least one position decoupled from the primary tappet can be assumed by the element feed, and the element feed can be moved in the coupled position together with the primary tappet in the axial direction and remains stationary relative to the housing in the decoupled position upon a movement of the primary tappet and further comprising a secondary tappet that is fixed within the housing by a coupling element, the primary tappet being axially surrounded by the secondary tappet.

18. A tool for joining components with a housing, in which a primary tappet composed of a punch and a hold-down device is mounted such that it can be driven in an axial direction (A), a die assigned to the punch and an element feed that can be moved in the axial direction relative to the housing, via which auxiliary joining parts can be fed to the primary tappet, wherein at least one position coupled at least indirectly to the primary tappet and at least one position decoupled from the primary tappet can be assumed by the element feed, and the element feed can be moved in the coupled position together with the primary tappet in the axial direction and remains stationary relative to the housing in the decoupled position upon a movement of the primary tappet and, wherein the hold-down device is arranged coaxially between the primary tappet and a secondary tappet.

19. The tool according to claim 18, wherein the element feed is located at a free end of the secondary tappet, which is assigned to the punch, and can be fixed to or detached from the hold-down device.

* * * * *